US005275182A

United States Patent [19]

Northcutt

[11] Patent Number: 5,275,182

[45] Date of Patent: Jan. 4, 1994

[54] HORSE HAIR BANDING COMB

[76] Inventor: Wayne E. Northcutt, P.O. Box 1002, Crockett, Tex. 75835

[21] Appl. No.: 5,133

[22] Filed: Jan. 15, 1993

[51] Int. Cl.[5] ..... A45D 24/38

[52] U.S. Cl. ..... 132/144; 132/145; 132/158; 132/200; 119/83; 54/76

[58] Field of Search ..... 132/119, 124, 143, 144, 132/145, 158, 200; 119/83, 93; 54/76, 78

[56] References Cited

U.S. PATENT DOCUMENTS

| | | | |
|---|---|---|---|
| 988,379 | 4/1911 | Olson | 132/143 |
| 1,042,270 | 10/1912 | Rajala | 132/119 |
| 1,052,310 | 2/1913 | Burlando | 132/144 |
| 1,543,572 | 6/1925 | Joyce | 132/144 |
| 1,904,090 | 4/1933 | Shaw | 132/143 |
| 2,260,093 | 10/1941 | Rainville | 132/143 |
| 2,610,638 | 9/1952 | Franklin | 132/119 |
| 3,120,852 | 2/1964 | Sawyer | 132/145 |
| 4,018,238 | 4/1977 | Ishida | 132/143 |

FOREIGN PATENT DOCUMENTS

| | | | |
|---|---|---|---|
| 631817 | 12/1927 | France | 132/144 |
| 2364633 | 4/1978 | France | 132/219 |

*Primary Examiner*—Gene Mancene
*Assistant Examiner*—Frank A. LaViola
*Attorney, Agent, or Firm*—Harrison & Egbert

[57] ABSTRACT

A horse hair banding comb having a comb member with a plurality of teeth and a plurality of receptacles formed therein and a looking member removably affixed to the comb member. The looking member extends over the teeth. The looking member has an edge positioned in proximity to the receptacle area. The receptacle areas allow horse hair to pass therethrough. The comb member is made up of a body, a first tooth having a V-shaped configuration and extending downwardly from the body, a second tooth having a V-shaped configuration and extending downwardly from the body, and a first receptacle area formed in the body between the first and second teeth. The locking member includes a first bar and a second bar in generally parallel spaced relationship. The comb member is positioned within this spaced area between the first and second bars.

15 Claims, 2 Drawing Sheets

HORSE HAIR BANDING COMB

TECHNICAL FIELD

The present invention relates to combs, in general. More particularly, the present invention relates to combs and other devices used for the banding of horse hair found in the mane of a horse.

BACKGROUND ART

Virtually all horses have a mane of hair which is formed along the top surface of the horse's neck. This mane of hair is quite prominent in some types of horses and less prominent in other types of horses. The mane of hair is generally a very coarse hair which extends upwardly from the neck of the horse. If the horse's mane is left untended, the mane of hair will generally have a rather unruly appearance. The hair may extend out at awkward angles and may be of uneven lengths.

There are many events in which the horse's appearance is of a great deal of significance. Particularly, show horse events require that the horse have an excellent appearance and have good grooming. The horse's appearance can also have some significance in some equestrian events and in some racing events. In order to properly groom the horse, the horse's mane must be clean, trimmed, and otherwise tended to.

Many owners of show horses consider it desirable to "band" the mane of the horse. The procedure of banding the horse's mane is similar, in concept, to the formation of braids of hair or children's pigtails. Typically, sections of the horse's mane are tied together or braided together. This can be a very time consuming process. Often, it is difficult to achieve proper uniformity in the banding of the horse's mane. Depending on the accuracy of the person carrying out the banding, the clumps of hair may be generally uneven.

The procedure for the banding of a horse's mane is made even more complicated by the fact that the horse can become impatient and will move around. This makes it difficult to take the necessary steps so as to make sure that the mane is banded in a proper manner. As such, typical human-style combs will not accomplish the task for horse hair. If the horse moves, then the comb will become dislodged and be difficult to properly reset.

One product that has appeared on the market has been used for the banding of horse hair. This product is known as a "Perfect Band (TM)". The product is presently sold by Perfect Band, Inc. of Townsend, Mass. This device utilizes a tubular member having a slot extending longitudinally through the tubular member. A handle is formed on the tubular member so as to allow the user to properly maintain the member in a proper position. The hair of the horse is placed through the slot formed in the tube. Bands may then be applied to the hair extending outwardly from the other end of the slot. This device utilizes a tough latex band that requires no twisting and lays flat against the base of the mane. In normal use, this is a complicated procedure which makes it difficult to quickly band the mane of the horse.

It is an object of the present invention to provide a horse hair banding comb that quickly speeds the process of banding.

It is another object of the present invention to provide a banding comb that is easy to use and which will stay in place during the banding process.

It is a further object of the present invention to provide a banding comb which is relatively inexpensive and easy to manufacture.

These and other objects and advantages of the present invention will become apparent from a reading of the attached specification and appended claims.

SUMMARY OF THE INVENTION

The present invention is a horse hair banding comb which comprises a comb member having a plurality of teeth formed thereon and a plurality of receptacles formed thereon, and a locking member which is removably affixed to the comb member. The teeth of the comb member generally taper and open to the plurality of receptacle areas. The locking member extends over the teeth. The locking member has an edge which is positioned in proximity to the receptacle areas. The receptacle areas allow horse hair to pass therethrough.

The comb member specifically comprises a body, a first tooth having a V-shaped configuration and extending downwardly from the body, a second tooth having a V-shaped configuration and extending downwardly from the body, and a first receptacle area formed in the body between the first tooth and the second tooth. The receptacle area has a generally circular configuration and a diameter suitable for receiving a plurality of horse hairs. The first tooth has an end spaced from an end of the second tooth by a distance of between $\frac{3}{8}$ inch and $\frac{5}{8}$ inch. The receptacle area has a diameter of between 3/16 inch and $\frac{1}{4}$ inch. The body has a length of between 5 and 9 inches.

The locking member includes a first bar and a second bar connected in spaced parallel relationship to the first bar. The edge is formed on the second bar. The comb member is positioned into the area of the spaced relationship of the first and second bars. The first bar has a width which is less than the width of the second bar. The edge of the second bar extends linearly across the comb member adjacent to the receptacle area. The first bar has an edge which extends below the end of the teeth. The locking member further includes snap-fit projections formed on opposite sides of the locking member. The snap-fit projections detachably engage complementary snap-fit receptacles formed on the side of the comb member.

The present invention is also a method of banding horse hair which comprises the steps of: (1) inserting a comb member into a first section of horse hair; (2) moving the comb member through the horse hair so that the hair is accumulated in the receptacle areas; (3) attaching a locking member to the comb member so as to retain the horse hair in the receptacle area; and (4) banding the accumulation of horse hair extending through the receptacle areas.

The step of attaching specifically includes the step of sliding the body member over the teeth of the comb member until the linear edge of the locking member extends in proximity to the receptacle areas. The linear edge serves to retain the horse hair within the receptacle areas. The locking member is then snap-fitted to the comb member so as to retain the comb member within the locking member.

The method of the present invention further includes the steps of removing the locking member from the comb member after the step of banding, removing the comb member from the banded horse hair, and then moving the comb member to a different section of horse hair adjacent to the first section of horse hair. During the removal of the comb, the banded horse hair passes from the receptacle areas through the space between the teeth of the comb. The step of banding includes grasping the accumulated horse hair extending through the receptacle area of the comb and placing an elastomeric band around the accumulated horse hair so as to secure the hair together.

DETAILED DESCRIPTION OF THE INVENTION

Figure 1:
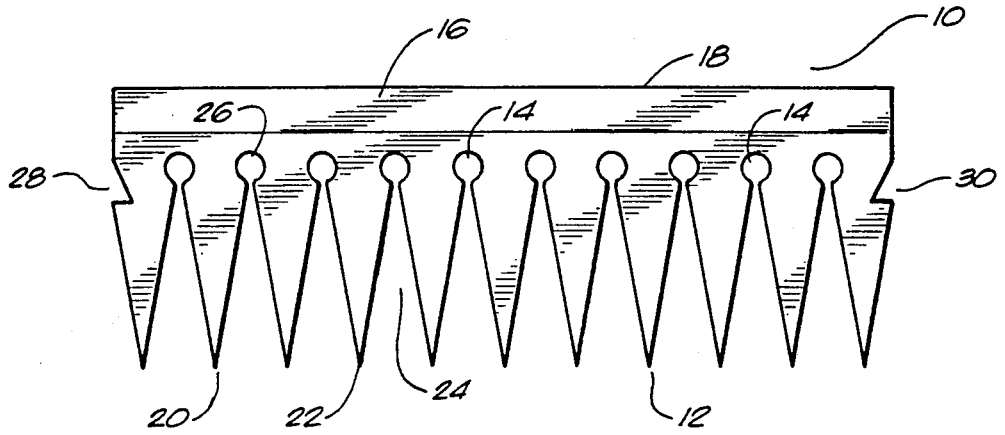
FIG. 1 is a front elevational view of the comb member of the present invention.

Referring to FIG. 1, there is shown at 10 the comb member in accordance with the preferred embodiment of the present invention. The comb member 10 has a plurality of teeth 12 formed thereon. The comb member 10 also has a plurality of receptacle areas 14 which open to the area between each of the teeth 12.

The comb member 10 has a body member 16 which has an upper linear edge 18. The comb member 10 can be formed of a plastic material. In general, the comb member 10 should be sufficiently flexible so as to allow the comb member 10 to properly pass through the hair of a horse's mane. The teeth 12 have a generally V-shaped configuration and extend downwardly from the body 16 of comb member 10. The receptacle areas 14 are formed in body 16 in the areas between the teeth 12.

The embodiment of the present invention includes a first tooth 20 and a second tooth 22. The arrangement of the first tooth 20 and the second tooth 22 can extend across the length of the comb member 10 and includes a plurality of such teeth. The description of a pair of the teeth 12, as first tooth 20 and second tooth 22, is merely for the purposes of illustration. The same scheme applies throughout the use of the plurality of teeth 12 formed on comb member 10. The first tooth 10 has a V-shaped configuration and extends downwardly from the body 16. Similarly, the second tooth 22 has a virtually identical V-shaped configuration. The second tooth 22 also extends downwardly from the body 16 in spaced relationship from the first tooth 20. A tapered space 24 is formed in the area between the first tooth 20 and the second tooth 22. The configuration of the tapered surfaces of the first tooth 20 and the second tooth 22 causes the horse hair to be received between the ends of the first tooth 20 and the second tooth 22 and to pass through the area 24 between the teeth. The hair will funnel to the receptacle area 26 at the opposite end of teeth 20 and 22. The receptacle area 26 has a generally circular configuration. The receptacle area 26 should have a suitable diameter for receiving a plurality of horse hair. The size of the receptacle area 26 can be varied in accordance with the desires of the user. For example, if larger clumps of horse hair are required, then the diameter of the receptacle area 26 can be increased. Similarly, the distance between the ends of first tooth 20 and second tooth 22 can also be increased so as to allow a greater amount of hair to pass into the receptacle area 26.

Within the scope of the present invention, the ends of first tooth 20 and second tooth 22 are spaced by a distance of between $\frac{3}{8}$ of an inch and $\frac{5}{8}$ of an inch. It has been found that this distance is suitable for allowing the proper amount of horse hair to be funnelled into the receptacle area 26. A greater distance between each of the teeth 20 and 22 would cause too much hair to be drawn into the receptacle area 26. Similarly, when the distance between the first tooth 20 and the second tooth 22 is too small, then an insufficient amount of hair will pass into the receptacle area 26. The receptacle area will have a diameter of between 3/16 inch and $\frac{1}{4}$ inch. It has been further found that the length of comb member 16 should be between 5 and 9 inches. When the length of the comb is greater than 9 inches, the comb member becomes unwieldy in use. Smaller sizes will adversely affect the consistency of the banding of the hair and will also adversely affect the linearity of the banding pattern.

The comb member 10 includes a first snap-fit receptacle 28 formed on one side of comb member 10 and a second snap-fit receptacle 30 formed on the opposite side of the comb member 10. The snap-fit receptacles are suitable for being removably affixed within a locking mechanism, as described in FIG. 2.

Figure 2:
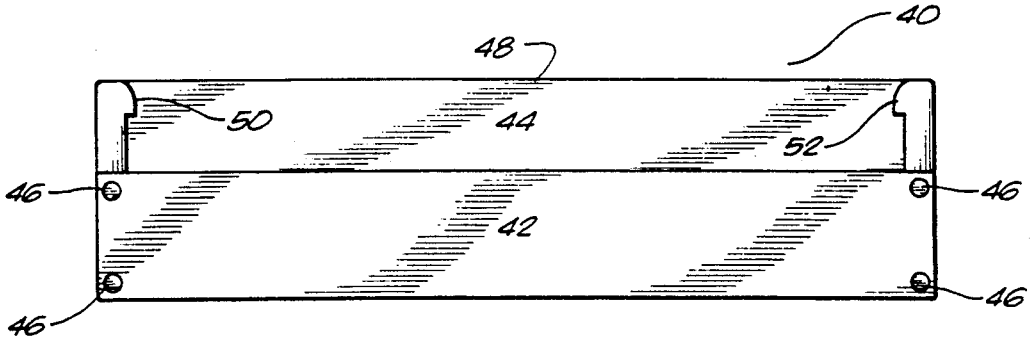
FIG. 2 is a front elevational view of the locking member of the present invention.

FIG. 2 illustrates the locking mechanism 40 of the present invention. The locking mechanism 40 includes a first bar 42 and a second bar 44. The first bar 42 and second bar 44 have a length which is slightly greater than the length of the comb member 10. The first bar 42 is affixed by fasteners 46 to the second bar 44. As will be described hereinafter, the first bar 42 is maintained in parallel spaced relationship from the second bar 44. The first bar 42 is a linear member having a lesser width than the width of the second bar 44. The second bar 44 is provided with an upper edge 48 which is suitable for being positioned in close proximity to the receptacle areas 14 of comb member 10 when the comb member 10 is inserted into the locking member 40. The locking member 40 includes a snap-fit projection 50 formed along one side and a second snap-fit projection 52 formed on the other side. In normal use, the first snap-fit projection 50 will engage the snap-fit receptacle 28 of comb member 10. Similarly, the snap-fit projection 52 will engage the snap-fit receptacle 30 of comb member 10. The snap-fit projections 50 and 52 serve to receive the comb member 20 within the locking member 40 and to retain such comb member 10 in its proper position.

Figure 3:
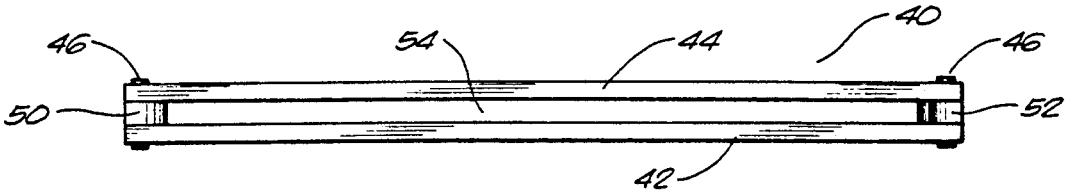
FIG. 3 is a top plan view of the locking member of the present invention.

FIG. 3 shows the locking member 40 along its upper edge. It can be seen that the locking member 40 has the first bar 42 arranged in spaced parallel relationship to the second bar 44. An interior receiving area 54 is provided between the first bar 42 and the second bar 44 so as to allow for the insertion of the comb member 10. The area 54 should generally correspond to the thickness of the comb member 10. It can be seen that the fasteners 46 retain the first bar 4 in its spaced relationship from the second bar 44. The snap-fit projections 50 and 52 extend inwardly from the sides of the locking member 40. The projections 50 and 52 further serve to assist in the proper spacing of the first bar 42 from the second bar 44.

Figure 4:
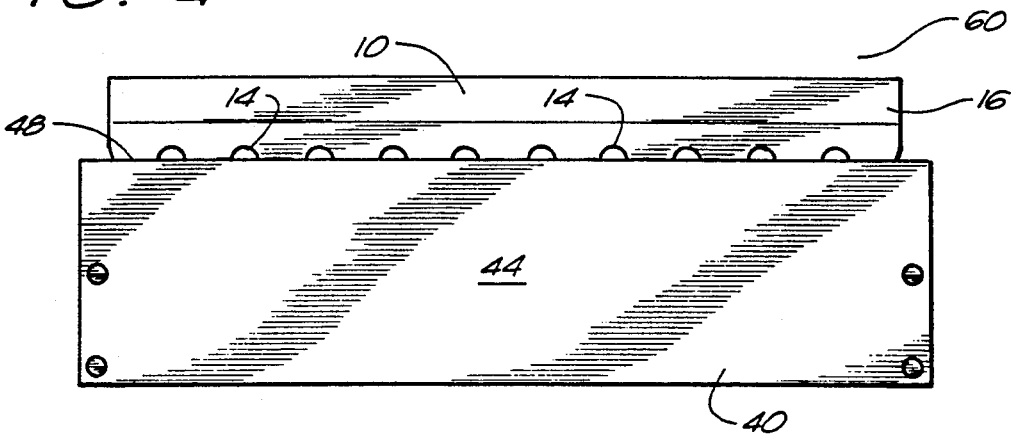
FIG. 4 is a rear elevational view of the comb of the present invention.

FIG. 4 illustrates the comb 60 of the present invention. It can be seen that the comb member 10 is inserted within the locking member 40. In the configuration illustrated in FIG. 4, the locking member 40 has its second bar 44 extending upwardly over the teeth of comb member 10. The second bar 44 has a linear edge 48 which extends across the body 16 of comb member 10. The positioning of edge 44 is in proximity to the linear array of receptacles 14 formed in the body 16. As such, when the horse hair is positioned through the receptacle areas 14, the linear edge 48 of the second bar 44 of locking member 40 will force all of the hair into the receptacle areas 14. As such, the receptacle areas 14 provide a clear area for the receipt of hair. The use of the locking member 40 serves to retain the hair within its proper position in the receptacle areas 14, despite any movements of the horse's head during banding. In this manner, the present invention is of great utility for the uniform banding of the horse's mane.

Figure 5:
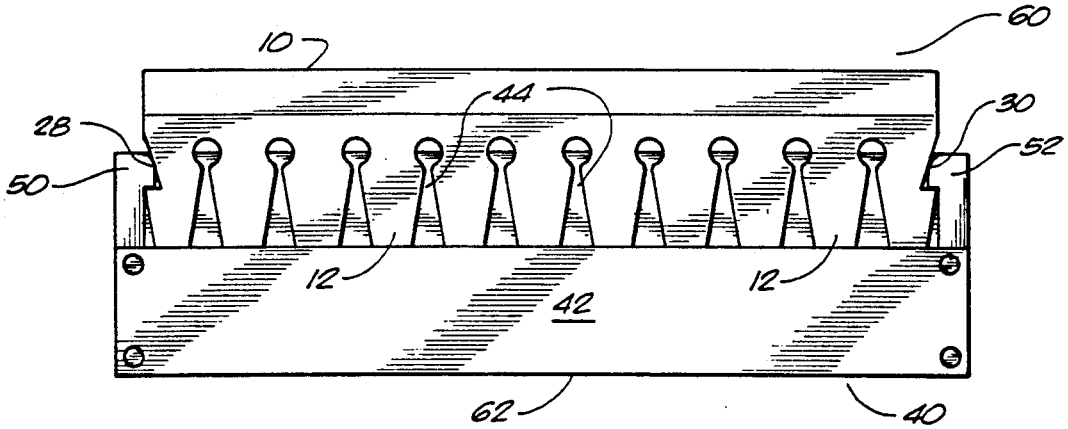
FIG. 5 is a front elevational view of the comb of the present invention.

FIG. 5 shows the other side of the comb 60. Specifically, it can be seen that the teeth 12 of comb member 10 are received within the area between the first bar 42 and the second bar 44. The first bar 42 has a bottom edge 62 which extends downwardly below the bottom edge of the teeth 12. It can be seen in FIG. 5 that the projections 50 and 52 of the locking member 40 engage the receptacle areas 28 and 30 of the comb member 10. These snap-fit projections serve to ensure that the comb member 10 is retained in position within the locking member 40. The teeth 12 of comb member 10 will extend between the inner surfaces of the first bar 42 and the second bar 44.

Figure 6:
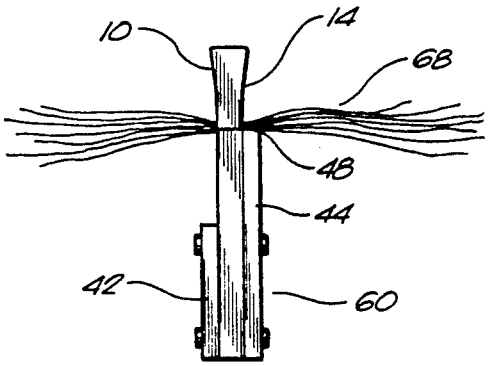
FIG. 6 is a side elevational view of the comb of the present invention showing, in particular, the horse hair extending through the receptacle area.

FIG. 6 illustrates how the horse hair 68 extends through the receptacle area 14 of the comb member 10. It can further be seen how that the first bar 42 is of a smaller height than that of the second bar 44. The second bar 44 has a top edge 48 which causes the horse hair 68 to be directed toward the receptacle area 14. As can be seen, the horse hair 68 only extends out of this receptacle area. None of the horse hair extends from the space between the teeth 12. The horse hair 68 extending outwardly of the comb 60 is in a suitable position for banding.

The method of the present invention is also of significance. The present method allows one to properly groom the horse and to band the hair of the horse in an efficient and attractive manner. Additionally, the comb member 10 is inserted into a first section of the horse hair. The comb member 10 is moved through the horse hair so that the hair 68 is accumulated into the receptacle areas 14 of the comb member. The locking member 40 is attached to the comb member such that the upper edge 48 tends to urge the horse hair into the receptacle 14 and to retain the horse hair in the receptacle area. The horse hair 68 can then be banded in an appropriate manner.

Since the locking member 40 has a linear edge 48, the locking member 40 can slide over the teeth 12 of the comb member 10 until the linear edge 48 extends in proximity to the receptacle areas 14. It is the linear edge 48 which retains the horse hair 68 within these receptacle areas. The locking member 40 can then be snap-fitted to the comb member 10 by affixing the snap-fit projections 50 and 52 into the snap-fit receptacles 28 and 30. This will serve to retain the comb member 10 within the locking member 40.

After the banding has been completed, the locking member 40 is removed from the comb member 10. The comb member 10 is then removed from the banded horse hair. The comb member 10 can then be moved to a different section of horse hair generally adjacent to the first section. So as to enhance the attractiveness of the banding, it is recommended that the hair be banded in a rather linear fashion. When the comb member 10 is removed from the banded horse hair, the comb member 10 slides such that the banded horse hair will pass from the receptacle areas 14 through the space 24 between the teeth.

The banding of the horse hair requires that the horse hair accumulated within the receptacle areas 14 be grasped. An elastomeric band can then be placed around the accumulated horse hair so as to secure the hair together.

The present invention is of great assistance in the banding of horse hair. First, the present invention properly accumulates horse hair in an even and linear manner. The use of the locking member allows the comb member to be properly retained on the horse hair. It also serves to prevent dislodgment of the comb member when the horse chooses to move its head. Each time the comb is used, many clusters of the horse's mane can be banded in a true and even manner. The comb member and the locking member can be relatively easily manufactured at a relatively low cost.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A horse hair banding comb comprising:

a planar comb member having a plurality of teeth formed thereon, said teeth tapering to a plurality of receptacle areas; and a locking member removably affixed to said comb member, said locking member extending around said teeth, said locking member having a straight liner edge positioned in proximity to said receptacle areas, said receptacle areas for allowing horse hair to extend therethrough; said locking member comprising:

a first bar; and a second bar connected to said first bar, said edge formed on said second bar, said comb member positioned between said first bar and said second bar, said first bar being in generally parallel spaced relationship to said second bar, said first bar having a width less than said second bar, said edge of said second bar extending linearly across said comb member adjacent said receptacle areas.

2. The comb of claim 1, said comb member comprising:

a body;

a first tooth having a V-shaped configuration and extending downwardly from said body;

a second tooth having a V-shaped configuration and extending downwardly from said body; and a first receptacle area formed in said body between said first tooth and said second tooth.

3. The comb of claim 2, said first tooth and said second tooth having an edge tapering to said receptacle area, said receptacle area opening to a space between said first tooth and said second tooth.

4. The comb of claim 3, said receptacle area having a generally circular configuration, said receptacle area having a diameter suitable for receiving a plurality of horse hairs.

5. The comb of claim 4, said first tooth having an end spaced from an end of said second tooth by a distance of between $\frac{3}{8}$ inch and $\frac{5}{8}$ inch.

6. The comb of claim 4, said receptacle area having a diameter of between 3/16 inch and $\frac{1}{4}$ inch.

7. The comb of claim 4, said body having a length of between five and nine inches.

8. The comb of claim 1, said teeth extending in the area of spaced parallel relationship between said first and second bars, said first bar having an edge extending below an end of said teeth.

9. A horse hair banding comb comprising:

a planar comb member having a plurality of teeth formed thereon, said teeth tapering to a plurality of receptacle areas, said comb member comprising:

a body;

a first tooth having a V-shaped configuration and extending downwardly from said body;

a second tooth having a V-shaped configuration and extending downwardly from said body; and a first receptacle area formed in said body between said first tooth and said second tooth; and a locking member removably affixed to said comb member, said locking member extending over and around said teeth, said locking member having a linear edge positioned in proximity to said first receptacle area, said first receptacle area for allowing horse hair to extend therethrough, said locking member further comprising:

a snap-fit projection formed on one side of said locking member, said snap-fit projection detachably engaging a complementary snap-fit receptacle formed on a side of said comb member and a second snap-fit projection formed on an opposite side of said locking member, said second snap-fit projection detachably engaging a complementary snap-fit receptacle formed on an opposite side of said comb member.

10. A method of banding horse hair comprising:

inserting a comb member into a first section of horse hair, said comb member having a plurality of teeth, said teeth tapering to a plurality of receptacle areas formed in said comb member, said receptacle areas extending generally linearly across said comb member;

moving said comb member through the horse hair so that the horse hair is accumulated in said receptacle areas;

attaching a locking member to said comb member so as to retain the horse hair in said receptacle areas;

banding the accumulation of horse hair extending through said receptacle areas;

removing said locking member from said comb member after the step of banding;

removing said comb member from the section of banded horse hair; and moving said comb member to a different section of horse hair adjacent said first section.

11. The method of claim 10, said locking member having a linear edge, said step of attaching comprising:

sliding said locking member over the teeth of the comb member until said linear edge extends in proximity to said receptacle areas, said linear edge retaining the horse hair within said receptacle areas.

12. The method of claim 11, said step of attaching further comprising:

snap-fitting said locking member to said comb member to as to retain said comb member within said locking member.

13. The method of claim 10, said step of removing said comb member comprising:

sliding said comb member from the banded horse hair such that the banded horse hair passes from the receptacle areas into and through a space between the teeth.

14. The method of claim 10, said step of banding comprising:

grasping the accumulated horse hair extending through the receptacle area of the comb member; and placing an elastomeric band around the accumulated horse hair so as to secure the hair together.

15. The method of claim 11, further comprising the step of:

forming the locking member so as to have a length generally corresponding to the length of said comb member, said locking member having a pair of bars in parallel spaced relationship, the space between the bars corresponding to a thickness of said comb member.

* * * * *